United States Patent [19]

Johnson

[11] Patent Number: 4,583,679

[45] Date of Patent: Apr. 22, 1986

[54] RESEALABLE PAPERBOARD PACKAGE

[75] Inventor: Harold D. Johnson, West Monroe, La.

[73] Assignee: Manville Service Corporation, Denver, Colo.

[21] Appl. No.: 738,929

[22] Filed: May 29, 1985

Related U.S. Application Data

[63] Continuation-in-part of Ser. No. 571,397, Jan. 17, 1984, abandoned.

[51] Int. Cl.[4] ..... B65D 5/68; B65D 43/04

[52] U.S. Cl. ..... 229/43; 206/621; 206/625; 220/258; 220/359; 229/3.1; 229/3.5 R; 229/7 R

[58] Field of Search ..... 229/7 R, 17 R, 43, 3.1, 229/3.5 R, 37 R, DIG. 5, 23 R, 23 BT; 206/620, 621, 625, 633; 220/258, 359

[56] References Cited

U.S. PATENT DOCUMENTS

| | | | |
|---|---|---|---|
| 1,295,997 | 3/1919 | Mennen | 229/7 R |
| 1,676,872 | 7/1928 | Schurmann | 229/DIG. 5 |
| 2,170,714 | 8/1939 | Ferguson | 229/43 X |
| 2,474,523 | 6/1949 | Guyer | 229/43 X |
| 2,536,990 | 1/1951 | Williamson | 229/DIG. 5 |
| 2,580,586 | 1/1952 | O'Reilly | 229/43 X |
| 2,652,186 | 9/1953 | Zinn, Jr. | 229/37 R |
| 2,760,713 | 8/1956 | Andrews | 206/633 |
| 2,902,202 | 9/1959 | Fallert | 229/23 R |
| 2,903,173 | 9/1959 | Hopkins | 229/44 R X |
| 3,064,876 | 11/1962 | Warner | 229/43 |
| 3,073,501 | 1/1963 | Williamson | 229/44 R X |
| 3,110,436 | 11/1963 | Wagner | 229/43 |
| 3,132,666 | 10/1938 | Williams | 229/DIG. 5 |
| 3,229,890 | 1/1966 | Wright | 229/37 R |
| 3,756,501 | 9/1973 | Skillen et al. | 229/44 R |
| 3,917,157 | 11/1975 | Smith | 229/43 |
| 3,965,271 | 6/1976 | Harrington | 229/3.5 R |
| 3,972,467 | 8/1976 | Whillock et al. | 229/3.5 R |
| 4,196,841 | 4/1980 | Smith et al. | 229/43 |
| 4,209,126 | 6/1980 | Elias | 220/359 |
| 4,280,653 | 7/1981 | Elias | 220/359 |
| 4,305,524 | 12/1981 | McLaren et al. | 229/43 |
| 4,328,924 | 5/1982 | Neff et al. | 229/43 |
| 4,355,721 | 10/1982 | Knott, II et al. | 229/3.5 R |
| 4,358,025 | 11/1982 | Urion | 220/258 |
| 4,365,739 | 12/1982 | Webinger | 229/43 X |
| 4,436,206 | 3/1984 | Kuchenbecker | 206/633 X |
| 4,444,355 | 4/1984 | Cary | 229/43 |
| 4,469,258 | 9/1984 | Wright et al. | 229/43 |

FOREIGN PATENT DOCUMENTS

| | | | |
|---|---|---|---|
| 790950 | 9/1935 | France | 229/37 R |

OTHER PUBLICATIONS

Modern Packaging Encyclopedia, "Properties of Packaging Films", pp. 180, 181 (1950).

*Primary Examiner*—Stephen P. Garbe
*Assistant Examiner*—Gary E. Elkins
*Attorney, Agent, or Firm*—John D. Lister; Cornelius P. Quinn

[57] ABSTRACT

A resealable paperboard package has all surfaces thereof coated with a moisture resistant, non-slippable, heat sealable material and is provided with outwardly biased side panel extensions located about the upper periphery of the base which intimately contact the side panels of the top to form a seal between the base and the top even when the top is replaced on the base after the package has been opened. A flexible sheet is heat sealed to the upper periphery of the base.

7 Claims, 16 Drawing Figures

RESEALABLE PAPERBOARD PACKAGE

REFERENCE TO RELATED APPLICATION

This application is a Continuation in Part of U.S. patent application Ser. No. 06,571,397 filed on Jan. 17,1984, now abandoned.

BACKGROUND OF THE INVENTION

This invention relates to resealable package of the type adapted to inhibit or prevent vapor transmission to or from the interior of the package. Packages of this type are generally used for breakfast cereals, snack foods, flour mixes, and other applications requiring low vapor transmission throgh the package. Conventional packages used for these materials normally employ an outer paperboard package and an inner bag which contains the product. While the sealed inner bag may aid in reduced vapor transmission, once this type of package has been opened, it is very difficult to reseal the package to prevent the transmission of vapor into or out of the package. The present invention, on the other hand, provides a package which not only eliminates the need for a bag within the paperboard package, but also provides a means for resealing the package to inhibit the transmission of vapor into or out of the package. While packages with removable tops are known in the art, no prior art package exists which provides the vapor proof barrier as does the present invention.

SUMMARY OF THE INVENTION

The present invention comprises a resealable paperboard package which includes a base, a removable film layer, and a top. The base comprises a bottom and a plurality of base side panels extending upwardly from the bottom. The base side panels are secured together to form a base with an open upper end. Each base side panel has a base side panel extension hingedly joined thereto along a fold line at the upper edge of the base side panel. Each base side panel extension extends at an angle to the base side panel to which it is attached and is biased outwardly from the base side panel. The removable film layer is preferably a transparent film which is heat sealed to the upper open end of the base portion.

The top comprises a top central panel and a plurality of top side panels attached to, and depending from, the top central panel. The top central panel and the side panels are secured together to form a top with an open lower end complementary in shape to the open upper end of the base. The top is positioned over the open upper end of the base and the removable film layer. The top side panels are then in intimate contact with the base panel extensions which are biased into engagement with the top side panels. The removable film layer may or may not extend beyond the open upper end to contact the side panel extensions.

Upon receipt by the user, the top is secured to the base but is adapted to be separated wholly or partially from the base. After removal of the top, the removable film layer may be removed to expose the contents of the base portion. After use, the top may be replaced over the upper open end of the base. The frictional contact of the top and the base side panel extensions provides a substantially vapor proof seal to protect the contents.

The base and the top are made from paperboard coated on all surfaces with a heat sealing vapor proof coating. This coating is preferably polyethylene. The film layer is preferably treated polypropylene. The coated base and top are heat sealed so that the product contained within the package remains free flowing and the migration of vapor into or out of the interior of the package is prevented. Another advantage of the present invention relates to the reinforcement of the base side walls by the top. For certain applications this will allow the package to be formed from a lower point paperboard.

DESCRIPTION OF THE PREFERRED EMBODIMENT

Figure 1:
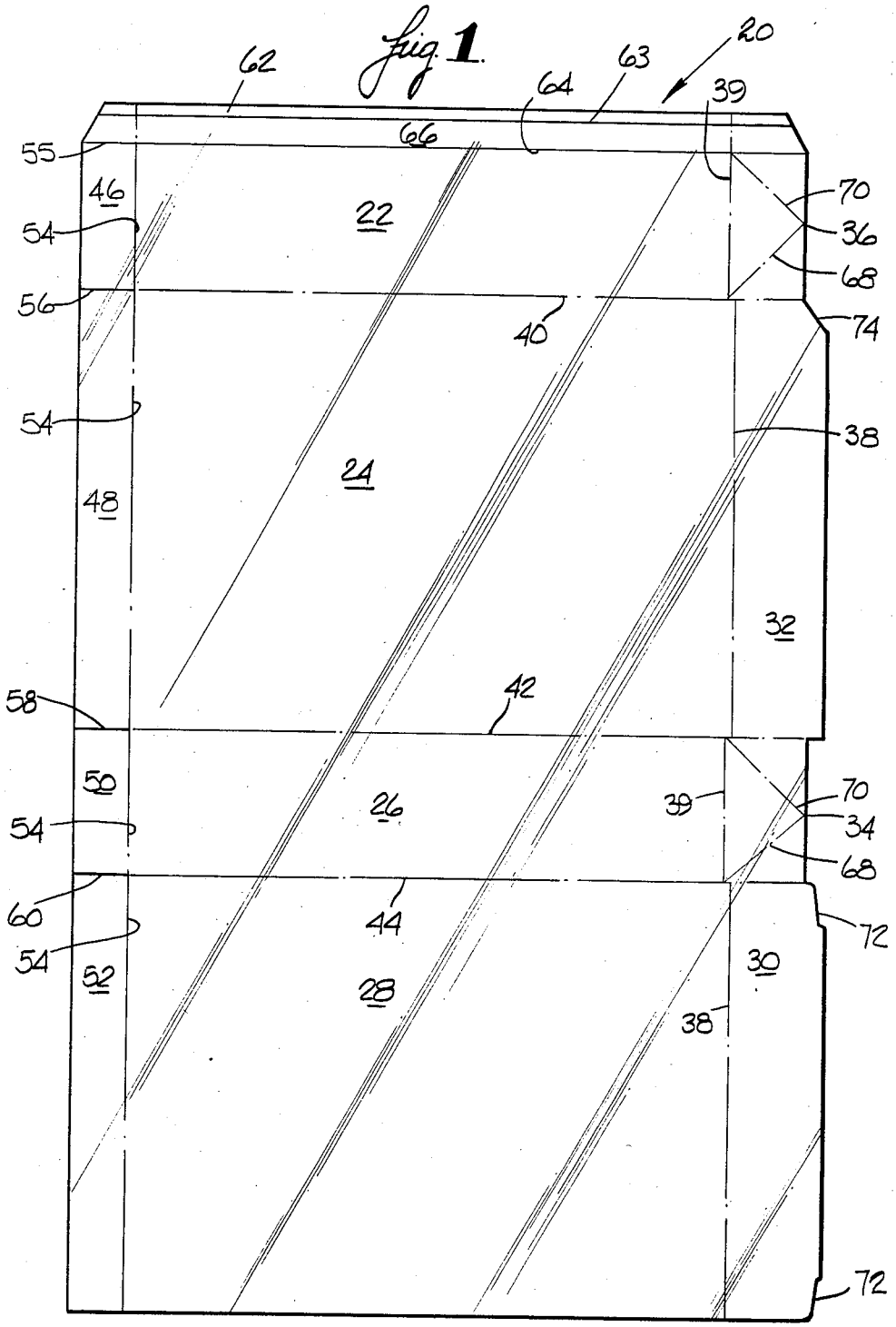
FIG. 1 is a plan view of the base blank.

Referring to FIG. 1, the base is formed from blank 20 which is illustrated in plan view in FIG. 1. The blank 20 includes four base side panels 22, 24, 26 and 28, two bottom panels 30 and 32, and two bottom gusseted tuck panels 34 and 36. Base bottom panels 30, and 32, are hingedly joined to the base side panels 28 and 24 respectively along horizontal score line 38 which extends along the lower edge of the base side panels. Tuck panels 34 and 36 are hingedly joined to base side panels 26 and 22 respectively along score lines 39 which are slightly offset from score line 38 as will be explained in more detail. Base side panels 22, 24, 26 and 28 are hingedly joined to each other by vertical score lines 40, 42 and 44 which coincide with the vertical edges of the base side panels intermediate panels 22 and 24, and 24 and 26, and 26 and 28 respectively.

The base side panels are provided with sealing extensions 46, 48, 50 and 52 which are hingedly joined to panels 22, 24, 26 and 28 respectively along a common horizontal score line 54 which extends along the upper edges of the base side panels. The sealing extensions 46, 48, 50 and 52 each extend the entire width of the base side panel to which they are joined and are separated from each other by cuts 55, 56, 58 and 60. The cuts 55, 56, 58 and 60 are aligned with score lines 64, 40, 42 and 44 respectively and extend completely through the paperboard from the free edges of the sealing extensions to the score line 54.

Referring to FIG. 1, the outside surface of blank 20 is shown. Both the outside surface and the inside surface (not shown) of the paperboard blank are coated with a heat sealable coating. Preferably, the outside surface is coated with 0.5 mil thickness of low density polyethylene. The inside surface is preferably coated with 1 mil thickness of high density polyethylene and then 0.5 mil thickness of low density polyethylene. These polyethylene layers are co-extruded onto the paperboard and provide the vapor proof barrier as well as allowing the surfaces to be heat sealed. Heat sealing the low density polyethylene layers together forms an extremely strong, vapor-proof seal. The use of conventional adhesives is thus eliminated. While polyethylene is a preferred coating, any suitable heat sealable coating may be applied to the paperboard as long as the coating is non-strippable and provides a strong bond. An example of a strippable coating is wax which may be intentionally or unintentionally scraped from the paperboard thus affecting the vapor proof characteristic of the package. Wax is also unsuitable because of its weak bonding strength.

Figure 16:
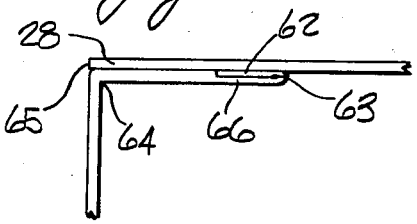
FIG. 16 is a top view of the side seam flap heat sealed to the side panel.

A score line 64 hingedly joins base side panel 22 to a side seam flap 66. Flap 66 has fold over flap 62 connected thereto along fold line 63. Prior to assembling the base, flaps 62 and 66 are skived on the outside surface and flap 62 is folded over onto flap 66 such that the skived surfaces are in contact. By skiving is meant the removal of a predetermined thickness of paperboard by abrasion or other methods as are known in the art. Flap 66 may be folded along score line 64 and heat sealed to the inner surface of panel 28 adjacent the free vertical edge of that panel to form a sleeve from blank 20 during the package forming operation. Because flap 62 is folded over onto flap 66 prior to heat sealing, it is the inner coated surface of flap 62 which is heat sealed to panel 28. The skiving allows the thickness of flap 66 and flap 62 to equal one thickness of paperboard. Thus panel 28 is held flat against flap 66 as shown in FIG. 16.

Tuck panels 34 and 36 are hingedly joined to bottom panels 30 and 32 along score lines 40, 42 and 44. Tuck panels 34 and 36 comprise three generally triangular shaped sections which are defined by score lines 44, 39, 42, 68, 70, 40, and 64. Tuck panels 34 and 36 are adapted to be folded along the beforementioned fold lines to be tucked under bottom panels 30 and 32 as will be explained in more detail. Inner bottom panel 30 is defined by score line 38 and score line 44 which hingedly joins inner bottom panel 30 to tuck panel 34. Outer bottom panel 32 is defined by score lines 38, 40, and 42. Score lines 40 and 42 join panel 32 to tuck panel 34 and 36. Inner bottom panel 30 includes rounded corners 72 while outer bottom panel 32 includes angled corner 74.

The grain of the paperboard in the base blank 20 extends parallel to score lines 38 and 54. The grain of the paperboard in the top blank 76 extends parallel to score lines 88 and 90. With the grains running in these directions the extensions 46, 48, 50 and 52 and the panels 80 and 82 tend to remain flat. With the grains running perpendicular to the preferred direction the extensions 46, 48, 50 and 52 may tend to become wavy thus adversely affecting the seal between the top and the base.

Referring to FIGS. 1 and 4–6 the base blank 20 is folded along score lines 64, 40, 42 and 44 to form a sleeve with the inner polyethylene coated surface of base side panel 28 adjacent its free edge overlapping the polyethylene coated flap 66. The inside surface of panel 62 and the non-skived outside surface of flap 66 are heat sealed to the inner surface of the base side panel 28 as shown in FIG. 16 to form the sleeve shown in FIG. 4. The side seam of the sleeve has no raw edges to permit moisture migration and the bond between the inside polyethylene coated surfaces forms a vapor proof seal. As shown in FIG. 16, only inner coated surface of panel 66 and fold line 63 are presented to the inside of the package. Thus, wicking of moisture from exposed edges such as edge 65 is prevented. Wicking occurs because uncoated paperboard edges tend to absorb moisture and carry it through the paperboard fibers and onto the package.

After the sleeve is formed the sealing extensions 46, 48, 50 and 52 are folded back along score line 54 toward their adjacent base side panels. However, because of the memory of the paperboard, the extensions are biased outwardly from the base side walls and do not lie flat against the sidewalls.

Figure 4:
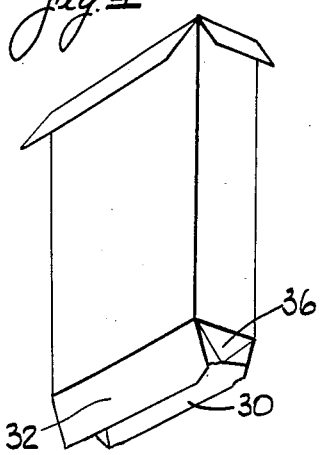
FIGS. 4–6 are schematic representations illustrating the fabrication of the base from the base blank.
Figure 5:
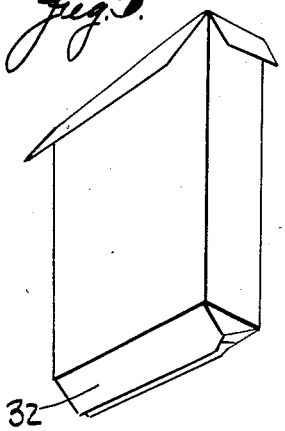
Figure 6:
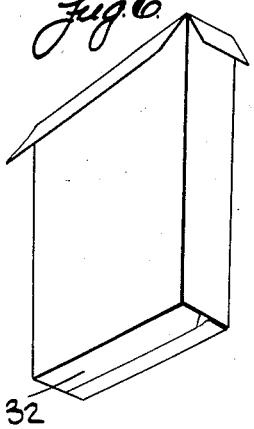
Figure 7:
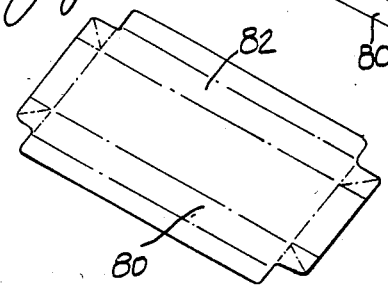
FIGS. 7–10 are schematic representations of the formation of the top from the top blank.

Tuck panels 34 and 36 are folded along score lines 39, 40, 42, 44, 64, 68, 70 and base panels 30 and 32 are folded along score line 38 to the position shown in FIG. 4 and then FIG. 5. Inner bottom flap 30 is then folded under flap 32 such that rounded corners 72 are inserted between the inside surfaces of flap 32 and tuck panels 34 and 36. As with the side seam, inner bottom flap 30 may include an extra panel such as panel 62 which may be folded back over flap 30 so as to present a rounded inside coated surface to the interior of the package. The bottom is then folded as in FIG. 6 and the bottom is heat sealed such that all contacting surfaces now form the polyethylene to polyethylene bond. With this bottom construction bottom panels 30 and 32 and tuck panels 34 and 36 exposed to the interior of the package are all polyethylene coated surfaces which are heat sealed. Accordingly, the assembled bottom presents no raw edges which would allow moisture migration and the bond between the polyethylene coated surfaces forms a vapor proof seal. After the base is formed it is filled with the material to be packaged. The material to be packaged is omitted from the FIGS. for ease of illustration.

Figure 2:
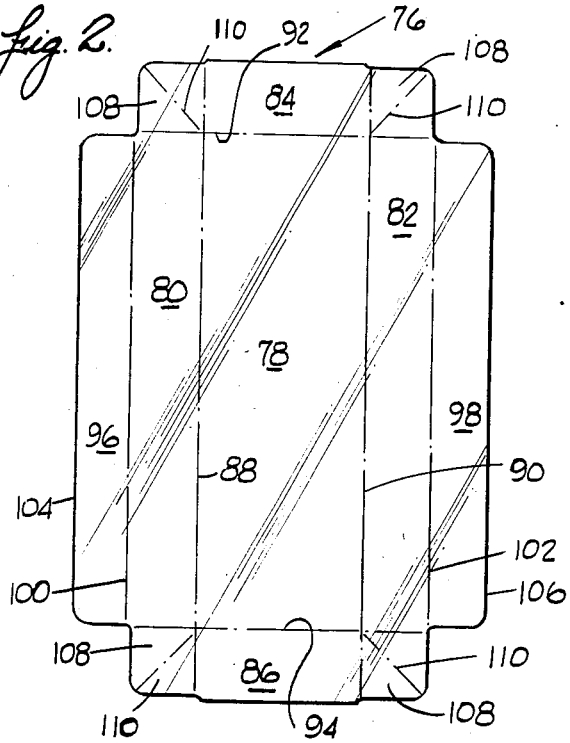
FIG. 2 is a plan view of the preferred embodiment of the top blank.

As illustrated in FIG. 2, the top is formed from a blank 76 which includes a top central panel 78 and top side panels 80, 82, 84 and 86. Side panels 80 and 82 are located on opposite sides of the top central panel 78 and are hingedly joined to the top central panel by score lines 88 and 90. The top side panels 84 and 86 have a horizontal dimension equal to the dimension of the top central panel edge to which they are joined along score lines 92 and 94 and a vertical dimension equal to the vertical dimension of the top side panels 80 and 82. The top side panels 84 and 86 are located on opposite sides of the top central panel 78 and are hingedly joined to the top central panel by score lines 92 and 94 respectively. The top side panels 80 and 82 have a horizontal dimension equal to the horizontal dimension of the top central panel edge to which they are joined.

Top side panels 80 and 82 have release panels 96 and 98 depending therefrom and hingedly joined thereto along score lines 100 to 102 respectively. The horizontal dimensions of the panels 96 and 98 equal the dimension of the top side panel edge to which they are joined. Gussetted corner flaps 108 are joined to top side panels 80, 82, 84 and 86 along fold lines 88, 90, 92 and 94.

Figure 8:
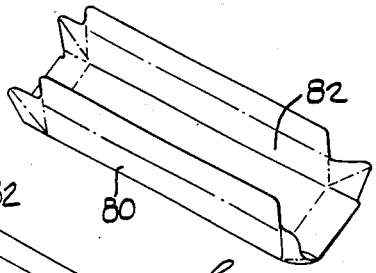
Figure 10:
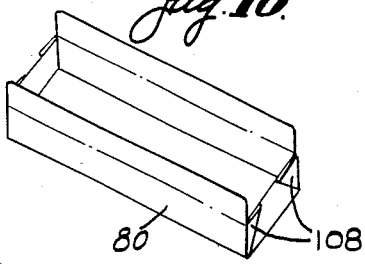
Figure 9:
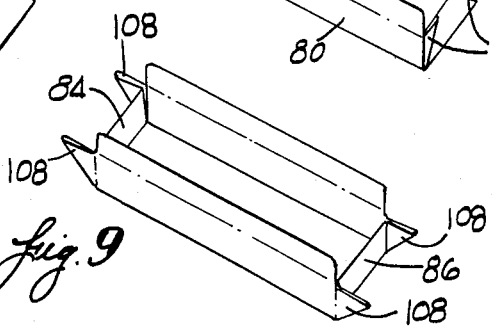

The top is formed as shown in FIGS. 7–10 on a mandrel (not shown). Side panels 80 and 82 are folded along fold lines 88 and 90 as shown in FIG. 8. Then, as shown in FIG. 9, side panels 84 and 86 are folded along fold lines 92 and 94. During this process gussetted flaps 108 are folded along diagonal fold line 110. Finally, flaps 108 are folded along fold lines 88 and 90 to contact side panels 84 and 86 as shown in FIG. 10. Flaps 108 are then heat sealed to side panels 84 and 86 by the same process as previously discussed. The result is a top, the corners of which are vapor proofed due to the polyethylene to polyethylene bond on all contacting surfaces.

Figure 11:
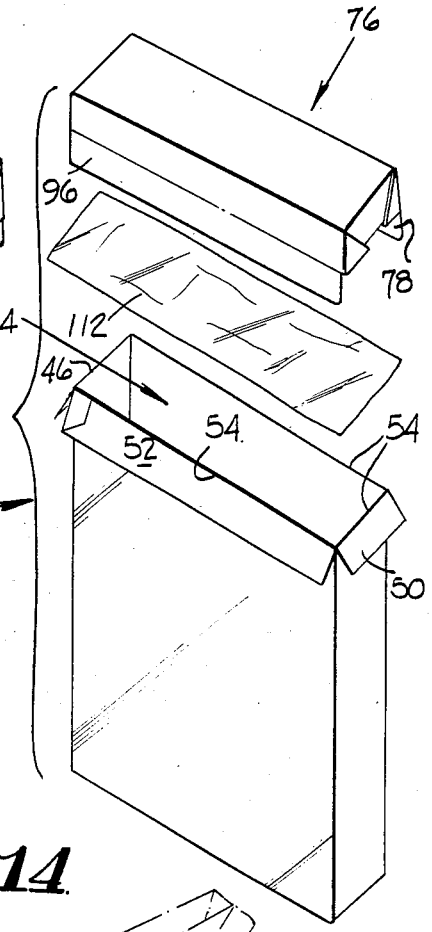
FIG. 11 is an isometric view of the package showing the top, the removable film layer, and the base separated.
Figure 12:
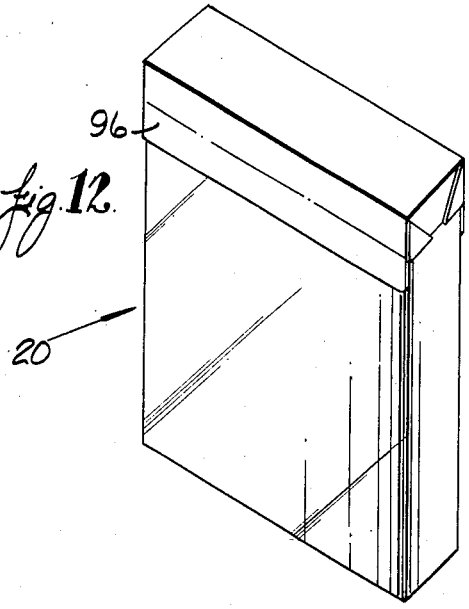
FIG. 12 is an isometric view of the finished package.

As shown in FIG. 11, once top 76 and base 20 are formed, they are assembled with a flexible film 112. Film 112 is preferably a polypropylene transparent film which is biaxially oriented polypropylene. This film is coated with polyvinylidene chloride (PVDC), which allows the film to be heat sealed to the upper open end 114 of base 20 which is defined by fold line 54. The use of the flexible film 112 allows the contents contained in base 20 to be vacuum sealed within the base. Once the film 112 is in place, top 76 is placed over the film 112 and base 20 and flaps 96 and 98 are heat sealed to base 20 to secure top 76 to base 20. A user, upon opening the package, simply pulls release panels 96 and 98 away from base 20. Flexible film 112 may then be peeled off base 20 to allow the contents of base 20 to be poured through upper open end 114. The completed package is as shown in FIG. 12.

After the user has removed as much of the contents of base 20 as is desired, top 76 may be placed back onto base 20 at which time flaps 46, 48, 50 and 52, being biased outwardly as previously described, will contact the inside of top 76, more specifically, top side panels 80, 82, 84 and 86. Because of the polyethylene coating on all surfaces of the container, the polyethylene to polyethylene frictional contact in conjunction with the outward bias of flaps 46, 48, 50 and 52, provide a substantially vapor proof seal to the interior of base 20. Thus, the contents of the container are protected and the container may be repeatedly opened and closed without subjecting the contents to harmful enviromental forces. Previous packages, even though they did allow for removal and replacement of the top, did not provide a vapor proof seal as does Applicant's invention. While some prior are devices may have employed a coating such as wax, such coating would be unsuitable for the present invention in that wax is a strippable coating which may be degraded or removed and thus weakens or destroys the vapor proof seal.

Figure 3:
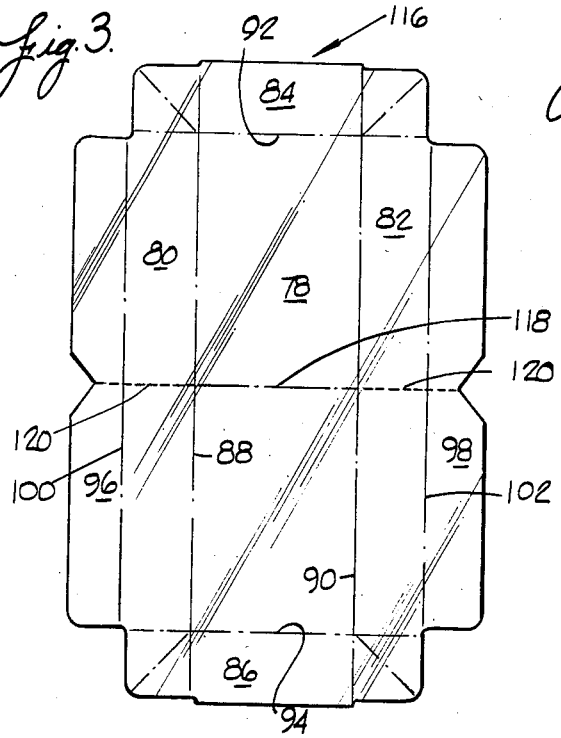
FIG. 3 is a plan view of an alternate embodiment of the top blank.
Figure 13:
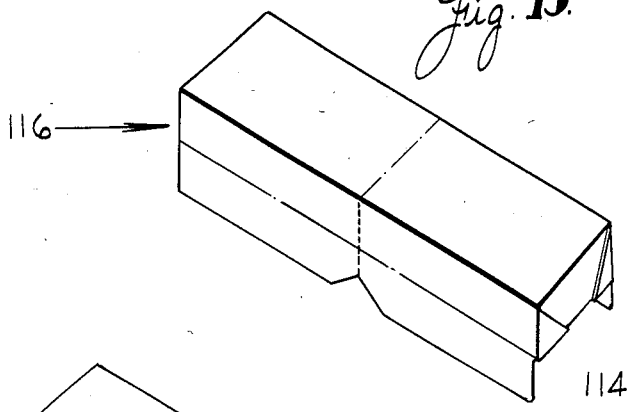
FIG. 13 is an isometric view of the alternate embodiment of the top portion.

Referring to FIGS. 3 and 13, an alternate embodiment of the top may be employed if desired. A top blank 116 is shown which is identical to blank 76 shown in FIG. 3 except for the addition of fold line 118 and skip cut portions 120. Skip cut portions extend from the angled edge of flaps 96 and 98 to fold lines 88 and 90 at top center portion 78. Fold line 118 extends from fold 88 across top center portions 78 to fold line 90. Blank top 116 is formed as was the previously disclosed top 76 as shown in FIGS. 7–10. The finished top 116 is as shown in FIG. 13.

Figure 14:
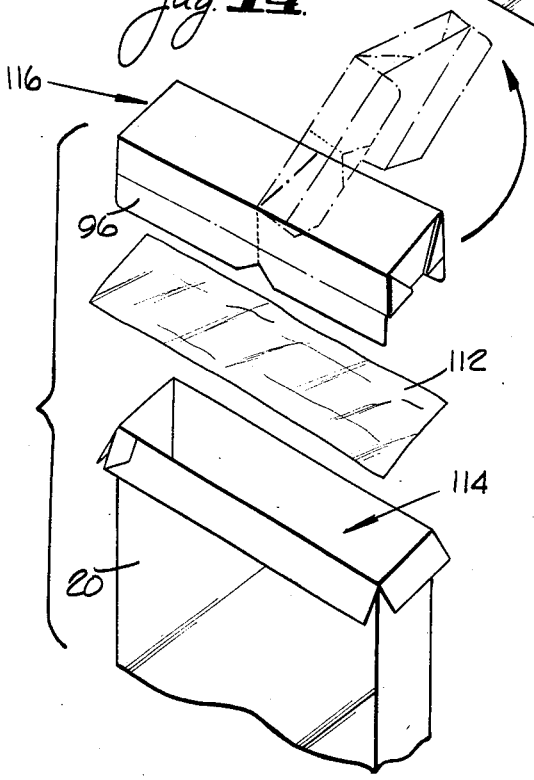
FIG. 14 is an isometric view of the package showing the top, the removable film layer, and the base separated.
Figure 15:
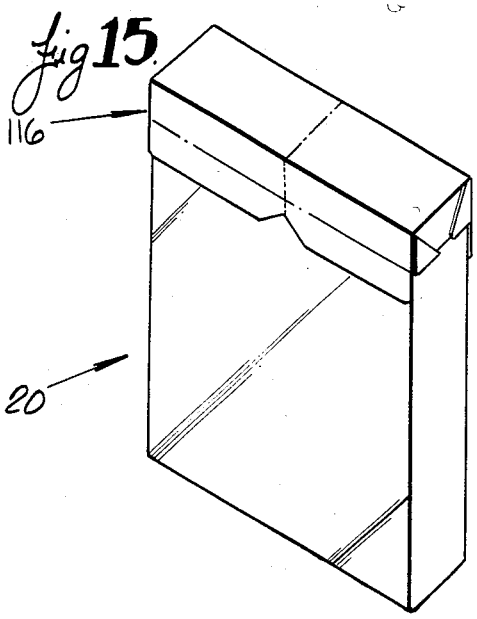
FIG. 15 is an isometric view of the finished package with the top portion of FIG. 13.

Referring to FIG. 14, top 116 may be assembled to base 20 as was previously described with respect to FIG. 11. The resultant package is as shown in FIG. 15. However, as shown in FIG. 14, rather than removing entire top 116, the user need only to break the heat sealed bonds on one portion of the top 116. That is, one half of top 116 may be heat sealed entirely along panels 96 and 98 to base 20 while the other half of top 116 may be lightly heat sealed. The user may then, by releasing only the lightly heat sealed portion of top 116, separate portions of side top panels 96, 98, 80 and 82 along skip cuts 120. The user may then fold a portion of top 116 back along fold line 118 as shown in FIG. 14. The result is that only a portion of the open end 114 of base 20 is open. This may be desired where it is undesirable for the entire top to be removed. While skip cut 120 and fold line 118 are shown approximately equidistant between fold lines 92 and 94 of top blank 116 in FIG. 2, it should be expressly understood that the skip cut and fold line could be located at any point between fold lines 92 and 94. Thus, while in FIG. 14, approximately half of top 116 is shown folded back, one third, two thirds, ninety percent or any other portion of top 116 could be folded back by locating skip cut 120 and fold line 118 appropriately. It is even possible that the entire top 116 could be folded back and yet stay attached to base 20. This would be accomplished by locating skip cut 120 and fold line 118 immediately adjacent to score lines 92 or 94.

While a preferred and an alternate embodiment of the invention have been disclosed, it is not to be so limited as changes and modifications may be made which are within the full intended scope of the invention as defined by the appended claims. For example, while preferred coatings have been disclosed for the package, any heat sealable non-strippable coating which results in a vapor proof seal may be employed without departing from the full intended scope of the invention. In addition, while a particular flexible film has been disclosed other suitable films may be advantageously employed with the invention as long as those films are capable of being heat sealed to the base to form a vapor proof seal. In addition, the amount of heat sealing of the film to the base may be varied to make portions of the flexible film extremely difficult to remove. That is, the degree of heat sealing could be varied such that only a certain portion of flexible film could be peeled from the base. This would accomplish substantially the same result as disclosed by the alternate embodiment of the top of FIGS. 2, 13, and 14.

What is claimed is:

1. A vapor proof, resealable paperboard package comprising:

a base including a bottom and a plurality of base side panels extending upwardly from the bottom and defining an open upper end, each base side panel having a base side panel extension hingedly attached thereto along a fold line at the upper end of the base side panel, each base side panel extension being folded back along its fold line away from said open upper end, the memory of the paperboard biasing each said extension outwardly from the base side panel to which it is attached so that it extends at an angle thereto;

a top including a top central panel and a plurality of top side panels attached to and depending from the top central panel, said top central panel and said top side panels being secured together to form said top with an open lower end complementary to the open top end of the base;

said paperboard base and top being coated with a heat sealable, non-strippable, moisture resistant coating on all surfaces thereof;

said top being positioned over, and peripherally surrounding, the upper end of the base with the top side panels being heat sealed to the folded back base panel extensions said coating allowing the heat seal adhering the top to the base to be broken and the top lifted from the package and, with no further heat seal and with the top repositioned on the base, producing sufficient frictional contact between said top side panels and said base panel extensions to provide, in concert with the outward bias of the base side panel extensions, a substantially vapor proof seal; and a flexible sheet heat sealed to said open upper end of said base such that said bottom, said base side panels, and said flexible sheet define a vapor proof enclosed space.

2. The package of claim 1 wherein said flexible sheet includes a biaxially oriented polypropylene sheet.

3. The package of claim 2 wherein said sheet is coated with polyvinylidene chloride.

4. The package of claim 1 wherein said coating includes polyethylene.

5. The package of claim 4 wherein the inside surfaces of said base and said top include a layer of high density polyethylene and a layer of low density polyethylene co-extruded onto said paperboard.

6. The package of claim 1 wherein said top further includes:

a fold line across the width of said top central panel; and skip cut lines on said top side panels, said skip cut lines being perpendicular to and intersecting said fold line at the junction of said top side panels and said top central panel.

7. The package of claim 1 wherein the top side panels include release panels hingedly connected thereto and extending downwardly therefrom to facilitate the removal of the heat sealed top.

* * * * *